US005435450A

United States Patent [19]

Delcambre

[11] Patent Number: 5,435,450

[45] Date of Patent: Jul. 25, 1995

[54] RAILROAD COUPLING KNUCKLE HOIST AND METHOD

[75] Inventor: E. B. Delcambre, Fort Smith, Ark.

[73] Assignee: Railroad Inventions Inc., Fort Smith, Ark.

[21] Appl. No.: 122,327

[22] Filed: Sep. 16, 1993

[51] Int. Cl.[6] ..... B66F 19/00

[52] U.S. Cl. ..... 213/100 R; 213/1 R; 254/325; 254/334

[58] Field of Search ..... 213/1 R, 75 R, 109, 213/100 R, 115, 155; 254/280, 325, 334, 342, 219; 294/67.22, 67.2, 82.23, 103.1

[56] References Cited

U.S. PATENT DOCUMENTS

| | | | |
|---|---|---|---|
| 531,318 | 12/1894 | Lantz | 254/280 |
| 933,959 | 9/1909 | Chalmers | 213/75 R |
| 1,741,660 | 12/1929 | Schmidt | 254/342 |
| 2,630,334 | 3/1953 | Ewers | 254/325 |
| 3,001,763 | 9/1961 | Pilot | 254/325 |
| 3,222,034 | 12/1965 | Jackson | 254/325 |
| 3,847,288 | 11/1974 | Hulcher | 213/111 |
| 3,938,781 | 2/1976 | Craven et al. | 254/175.7 |
| 4,079,842 | 3/1978 | Chierici | 213/166 |
| 4,113,114 | 9/1978 | Pounds | 213/75 |
| 4,263,797 | 4/1981 | Cooper | 72/40 |
| 4,338,703 | 7/1982 | Tanner | 254/325 |
| 4,468,004 | 8/1984 | Shaver et al. | 254/325 |
| 4,489,970 | 12/1984 | Henke | 294/67.22 |
| 4,597,562 | 7/1986 | Joyce | 254/334 |
| 4,640,422 | 2/1987 | Elliott | 213/155 |
| 5,072,962 | 12/1991 | Webb | 280/414.1 |
| 5,184,934 | 2/1993 | Gallo | 294/67.22 |
| 5,277,463 | 11/1994 | Singh et al. | 294/67.22 |

FOREIGN PATENT DOCUMENTS 1932865 1/1971 Germany ..... 254/334

OTHER PUBLICATIONS

Safety Corrective Action Team; "New Safety Equipment Bulletin"; New Safety Equipment Update; Release No.: 4021A-9; Jun. 23, 1989; vol. 1, No. 6.

*Primary Examiner*—Mark T. Le

[57] ABSTRACT

A railroad coupling knuckle hoist and method is provided which facilitates the movement, lifting and placement of a knuckle in an operative position in the coupling head of a drawbar in a safe and efficient manner by using a portable, lightweight knuckle hoist which is temporarily attached to the upper surface of a drawbar and which serves to mechanically move, lift, and maintain a knuckle in position to be received in the coupling head. In accordance with one example, the railroad coupling knuckle hoist includes a base which is adapted to be placed on the upper surface of the horn of a drawbar adjacent the buffing surface, a securing chain for temporarily securing the base to the drawbar, a winch attached to the base and including a crank handle for manually operating the winch, a boom extending upwardly from the base and including a guide element at the free end thereof for guiding a lifting cable from the winch in a position to lift a knuckle to a location adjacent a knuckle receiving recess in the coupling head of the drawbar, and a lifting assembly attached to the lifting cable and adapted to be temporarily clamped onto the knuckle while the knuckle is moved, lifted, and placed in the coupling head and detached from the knuckle once it is held in position within the coupling head of the drawbar by a temporary holding pin. A ramp is used for facilitating movement of a knuckle over a railroad train track.

5 Claims, 6 Drawing Sheets

RAILROAD COUPLING KNUCKLE HOIST AND METHOD

BACKGROUND OF THE INVENTION

The present invention is directed to railroad couplings, and more particularly concerns a hoist and related apparatus for facilitating and assisting in the replacement or placement of a knuckle in the coupling head of a drawbar.

Conventional railroad couplings or couplers for joining railroad cars one to another to form a train include opposing interlocking knuckles which are pivotally supported in respective coupling heads of opposing drawbars by knuckle or pivot pins. The knuckle pins are received in aligned openings in the knuckles and coupling heads of the drawbars with the openings having substantially vertical longitudinal axes which are offset from the center lines of the drawbars. The drawbars have neck or shank portions which are mounted in end sills of the railroad cars in a manner allowing the drawbars to slide into the end sill until a buffing surface of a raised portion or horn of the drawbar strikes a coupler striker on the exterior of the end sill. Typically the coupler shank is operably connected to the center sill of the car body through a conventional draft gear mechanism for standard draft gear cushioning of coupler impacts applied to the coupler and to provide for relative movement between the adjacent railroad cars. Conventional AAR F or E type railroad couplings are described, for example, in U.S. Pat. Nos. 4,079,842 and 4,640,422.

The interlocking knuckles of a conventional railroad coupling can be either in compression or tension, depending on the direction of movement of the train. When movement of the train reverses, and the knuckles change from a tension condition to a compression condition, the nose of each knuckle tends to slam into the throat portion of the other. After a period of time, this results in a metal fatigue condition with attendant cracks in the throat region of the knuckle. Complex and repetitive stress loadings on the coupling, particularly the knuckles and knuckle pins thereof, cause fatigue fracturing due to bending loads imposed upon movement of a train from a stopped condition as well as when the train reverses direction from a buff condition to a draft condition. Other conditions, such as rough terrain, worn railroad tracks, excessive weight due to heavy loads or especially lone trains, rocking or rolling of the railroad care, and rotation of the railroad cars for dumping while coupled to other cars by interlocking couplers constructed to accommodate rotary movement between the cars, brine about repetitive or excessive static or dynamic stress loadings on the knuckles and the knuckle pins. These conditions lead to failure of the knuckle pins and the knuckles.

Broken knuckle pins and knuckles of conventional railroad couplings lead to train separations, that is the separation of adjacent railroad cars in a train. In a six month study of train separations, it was found that broken knuckles caused almost 70% of train separations. When a train separates due to either a broken knuckle pin or knuckle, the train must be halted and the broken coupling element must be replaced so that the railroad cars can be reconnected one to another. The replacement of a knuckle in the field entails placement of a replacement knuckle and pin adjacent the separated railroad cars, the lifting of the heavy replacement knuckle (weighing about 80 pounds) up into position in the coupling head of a drawbar, placement of a knuckle pin in the coaxially aligned knuckle pin receiving openings of the coupling head and knuckle, insertion of a knuckle pin retaining key, followed by recoupling of the separated railroad cars by interlocking adjacent knuckles of the railroad coupling.

Replacement of a knuckle by a single trainman (brakeman, engineer, conductor) is difficult and dangerous due to the size and weight of the knuckle. Current railway procedures require that a train having only a single trainman (conductor) wait for additional assistance before attempting to manually replace a knuckle in the field. This downtime due to train separation may be quite lengthy as the required assistance may be hours away. A lengthy delay can cause a train to "go dead" and require a replacement or relief crew, rerouting of other trains, and train scheduling problems. Attempts at replacing knuckles by a single trainman can lead to physical injury and temporary or permanent disability of the trainman.

Still further, trainmen have been injured in train yards even with two trainmen attempting to place a knuckle in an operative position in a coupling head of a drawbar, because the knuckles are not only heavy but also cumbersome and difficult to maneuver with respect to the coupling head.

Hence, there is a need for an improved apparatus and method for moving, lifting or maneuvering a knuckle into an operative position within the coupling head of a drawbar, not only to avoid injury to a trainman attempting to replace a knuckle in the field but also to facilitate the placement of a knuckle in an operative position in a drawbar at the railroad yard.

SUMMARY OF THE INVENTION

In accordance with the present invention, a railroad coupling knuckle hoist and method is provided which facilitates the movement, lifting and placement of a knuckle in an operative position in the coupling head of a drawbar in a safe and efficient manner using a portable, lightweight knuckle hoist which is temporarily attached to the upper surface of a drawbar and which serves to mechanically move, lift, and maintain a knuckle in position to be received in the coupling head.

In accordance with one example of the present invention, the railroad coupling knuckle hoist includes a base which is adapted to be placed on the horn of a drawbar adjacent the buffing surface, means for temporarily securing the base to the drawbar, a winch attached to the base and including a crank handle for manually operating the winch, a boom extending upwardly from the base and including a guide element at the free end of the boom for guiding a lifting cable from the winch in a position to lift a knuckle to a location adjacent a knuckle receiving recess in the coupling head of the drawbar, and a lifting assembly attached to the lifting cable and adapted to be temporarily clamped onto the knuckle to be placed in the coupling head and detached from the knuckle once it is in position within the coupling head of the drawbar.

Also in accordance with the present invention, associated apparatus includes a temporary reduced diameter knuckle pin which is used to hold the knuckle in the drawbar while the lifting assembly is unclamped and removed from the knuckle and a ramp for facilitating movement of a knuckle over a railroad train track so that the knuckle hoist serves not only to lift the knuckle in position but also as a means for moving (dragging) the knuckle from a location adjacent a railroad track to a position directly beneath the coupling head of the drawbar in which it is to be placed. Thus, the knuckle hoist and associated apparatus of the present invention substantially eliminate the need for a trainman to drag, lift, or hold a knuckle during replacement or placement of the knuckle in an operative position in the coupling head of a drawbar.

In accordance with one method of the present invention, a knuckle is placed in an operative position within the coupling head of a drawbar using the knuckle hoist and associated apparatus by placing a knuckle on the ground in the area of the railroad coupling, for example, pushing the knuckle off of an engine or railroad car adjacent the railroad track and moving the train to locate the particular railroad coupling adjacent the knuckle, putting the coupling head in condition to receive the knuckle by, for example, using a conventional uncoupling lever retaining tool to retain an uncoupling lever in its uppermost position, thereafter placing the portable knuckle hoist in an operative position on the upper surface of the horn of the drawbar, securing the knuckle hoist to the drawbar, unwinding the lifting cable from the winch on the knuckle hoist a sufficient length to allow the lifting assembly to be clamped onto the knuckle, clamping the lifting assembly onto the knuckle, and rotating a crank handle of the winch to reel in the lifting cable and thereby draw the knuckle toward the coupling head.

If the knuckle is to be drawn over a railroad track, a ramp is placed in a position on the railroad track to facilitate movement of the knuckle over the railroad track and into position beneath the coupling head. Next, the crank handle is rotated to lift the knuckle from the railroad track to a position opposite the knuckle receiving recess in the coupling head. The hoist serves to hold the weight of the knuckle and allows for the knuckle to be easily pushed into position in the knuckle receiving recess of the coupling head far enough to allow the temporary reduced diameter knuckle pin to be slid down into the knuckle pin receiving recess in the upper portion of the coupling head and into the mating recess in the knuckle. Then, the lifting assembly is unclamped and removed from the knuckle with the temporary knuckle pin holding the knuckle in place so it does not escape from the knuckle receiving recess in the coupling head. The knuckle is pushed into final position within the coupling head, the temporary pin is removed, and a permanent knuckle pin is inserted in the knuckle pin receiving recesses of the coupling head and knuckle. Thereafter, the ramp is removed from the railroad track, the knuckle hoist is detached from the drawbar, and the conventional uncoupling lever retaining tool is removed from the uncoupling lever.

In accordance with the another aspect of present invention, the knuckle hoist is lightweight, for example, the knuckle hoist weighs about nine pounds, and the associated apparatus weighs about three pounds with a combined weight of less than twelve pounds. This light weight feature insures that the knuckle hoist is portable, safe to attach and detach from a drawbar by a single trainman. However, the knuckle hoist is constructed of sturdy and durable materials to provide for a lone service life and endure the rough conditions imposed during use and storage on a train.

In accordance with the present invention, it is envisioned that a single knuckle hoist and associated apparatus forming a knuckle replacement kit be stored on each train alone with replacement coupling elements to facilitate the safe, efficient, and effective replacement of broken coupling elements or the placement of coupling elements in a railroad coupling in the field or in a railroad yard by one or more trainmen.

The principle object of the present invention is the provision of a portable railroad coupling knuckle hoist which substantially reduces the need for manual movement or lifting of a knuckle during replacement of a broken knuckle or knuckle pin or placement of a knuckle in an operative position within a coupling head of a drawbar.

Another object of the present invention is the provision of a knuckle replacement kit which includes a knuckle hoist, a temporary reduced diameter knuckle pin, and a ramp for facilitating the movement of a knuckle over a railroad track.

A still further object of the present invention is the provision of an improved method for replacing a broken, missing, or damaged knuckle or for facilitating the reconnection of adjacent railroad cars following a train separation due to a broken knuckle or knuckle pin.

Yet still another object of the present invention is the provision of a lightweight, portable, railroad coupling knuckle hoist and method which substantially reduces the need for manual movement or lifting of a knuckle and thereby substantially eliminates injuries and disabilities caused by such manual movement or lifting of a knuckle.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
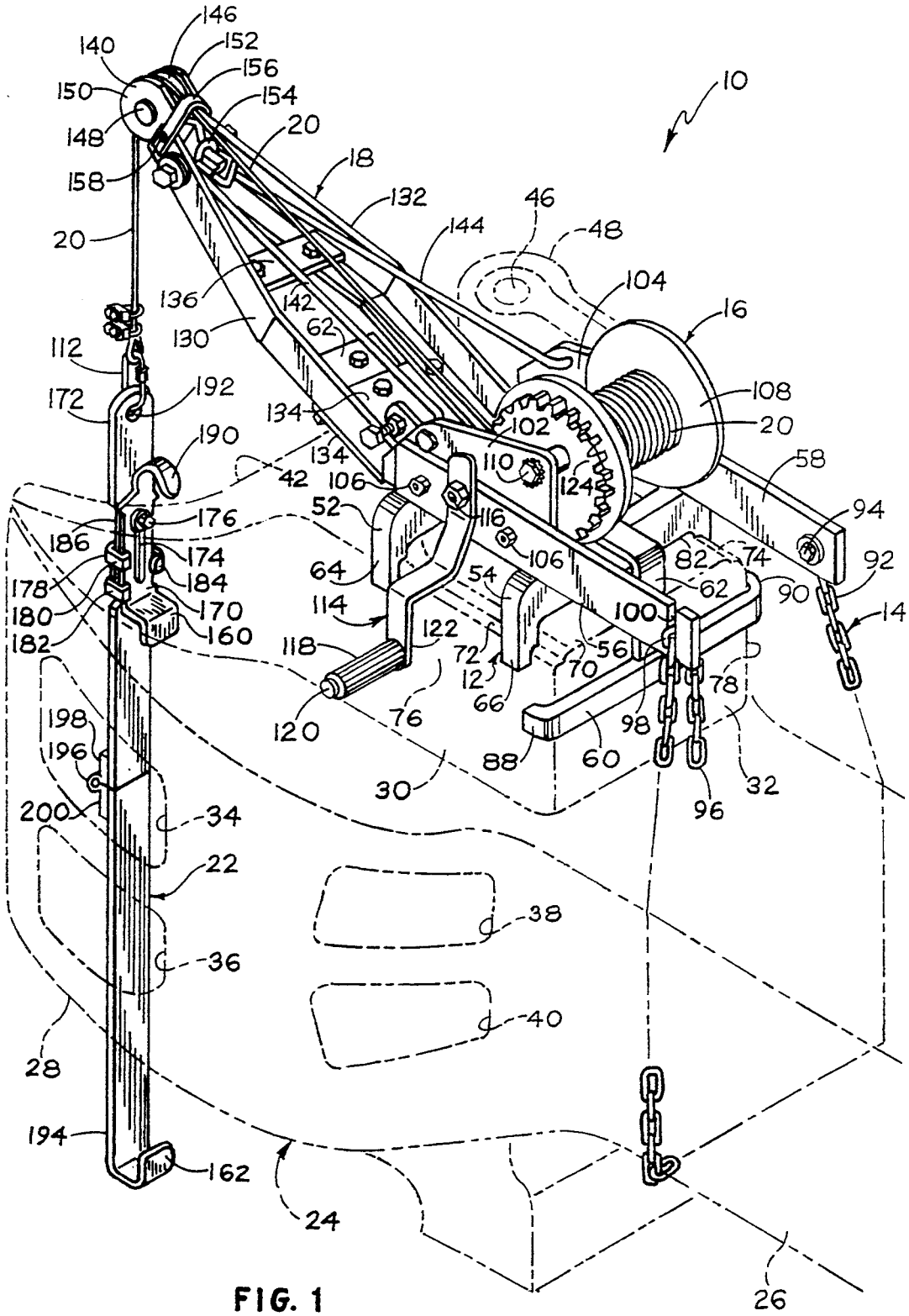
FIG. 1 is a perspective view illustrating a knuckle hoist in accordance with one embodiment of the present invention.
Figure 2:
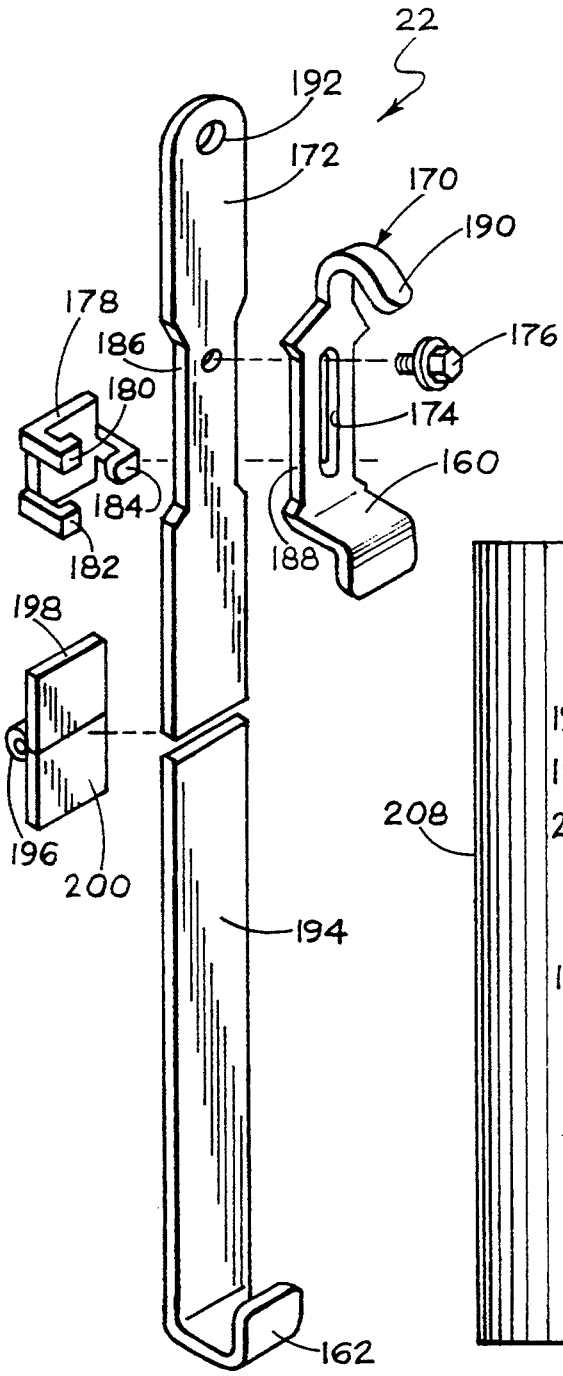
FIG. 2 is an exploded assembly representation of the lifting assembly of the knuckle hoist of FIG. 1.
Figure 4:
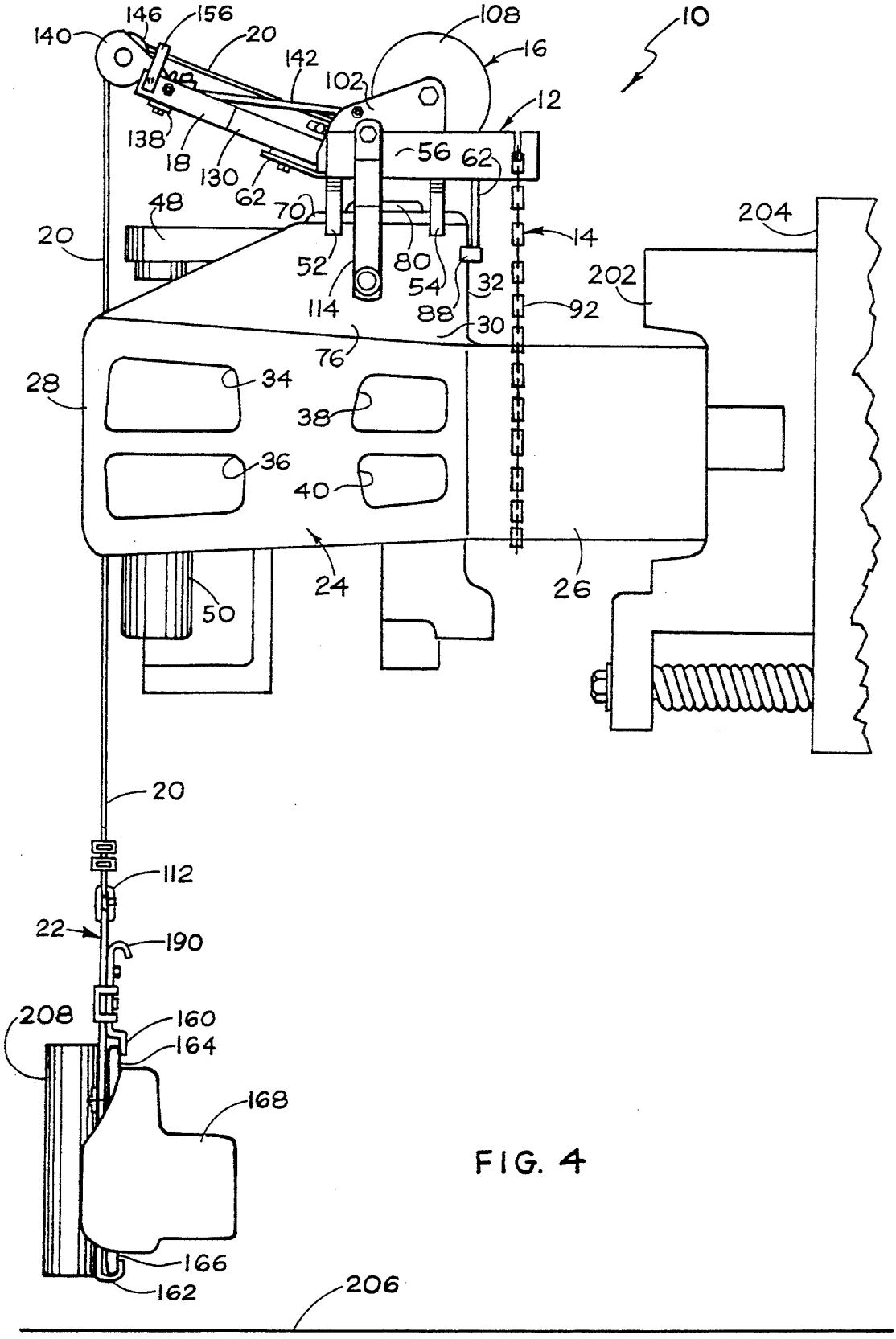
FIG. 4 is a schematic side view representation of the knuckle hoist of FIG. 1 in an operative position on top of a drawbar with a knuckle lifted from a railroad track.
Figure 5:
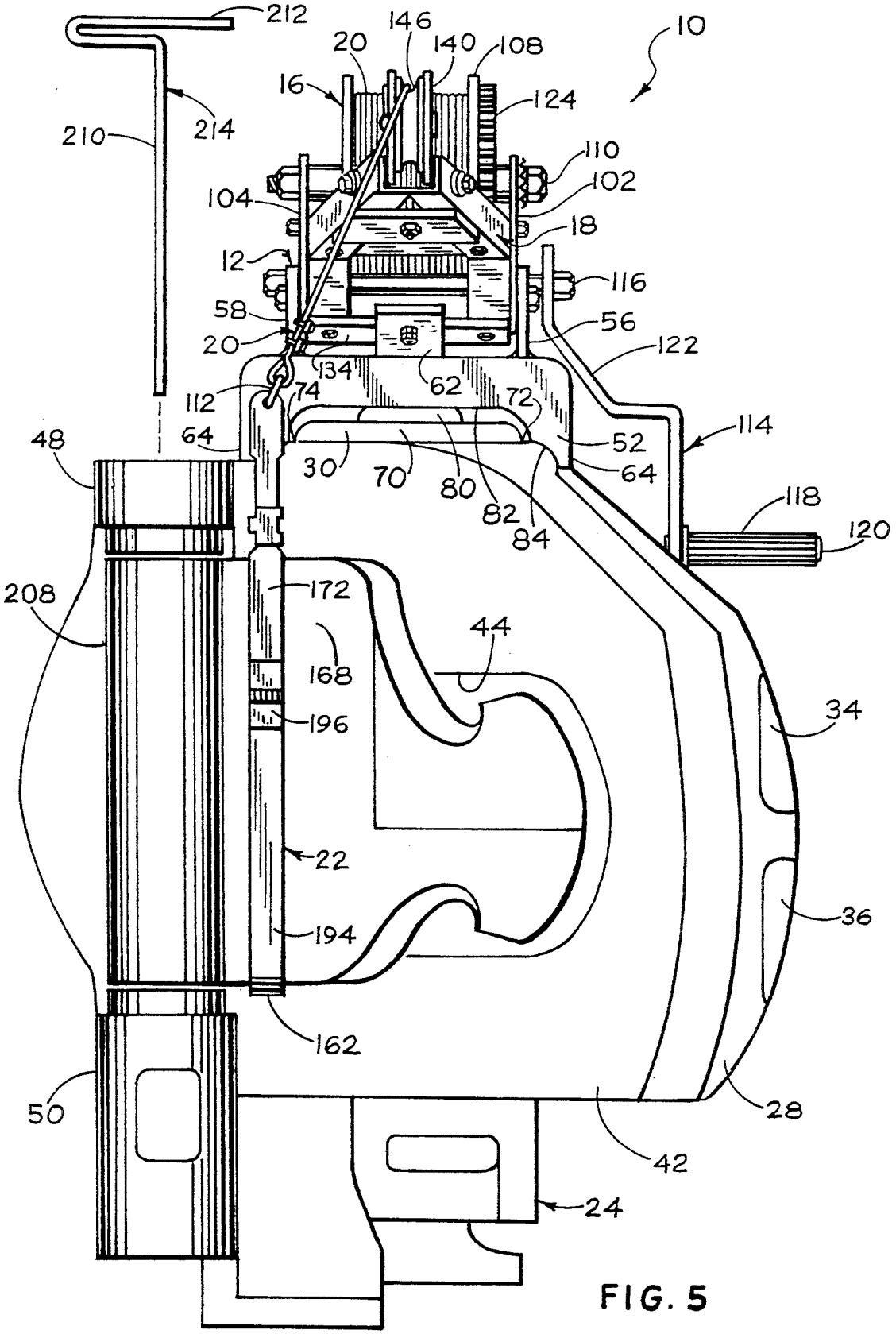
FIG. 5 is a schematic front view illustration of the knuckle hoist of FIG. 1 with a knuckle positioned in a coupling head with the knuckle pin receiving bores of the coupling head and knuckle sufficiently in line to allow for the insertion of a temporary reduced diameter knuckle pin into the bores.

In accordance with an exemplary embodiment of the present invention as shown in FIGS. 1, 4 and 5 of the drawings, a relatively lightweight, portable knuckle hoist generally designated by the reference numeral 10 is shown to include a base 12, securing assembly 14, a winch 16, a boom 18, a lifting cable 20, and a lifting assembly 22, mounted atop a conventional drawbar 24 (shown in phantom in FIG. 1 for the sake of clarity) having a shank or neck 26, a coupling head 28, a horn 30, a buffing surface 32, sand holes 34, 36, 38 and 40, a concave face 42, a knuckle receiving recess 44, a pivot pin or knuckle pin receiving opening 46, and upper and lower pivot pin protectors 48 and 50 (FIG. 5).

The base 12 of the knuckle hoist 10 is adapted to be placed in a stable operative position on the upper surface of the horn 30 of the drawbar 24. The base 12 includes a pair of spaced, vertically oriented support members or feet 52 and 54, a pair of frame members 56 and 58, a positioning bar 60, and a central support member 62. The members 56, 58, and 62 are secured to the upper surface of each of the vertical support members 52 and 54 by, for example, being welded thereto. Thus, the members 52, 54, 56, 58, and 62 and bar 60 are joined together to form an integral unit or base 12. The vertical support members 52 and 54 lie transverse to the horn 30 and rest upon the upper surface of the horn with outer portions 64 and 66 of each of the members 52 and 54 extending beyond sides 76 and 78 of the horn 30 and extending a short distance down along the sides 76 and 78 to provide for correct positioning of the base 12 with respect to the horn 30.

The horn 30 of conventional drawbar 24 has a raised portion 70 which forms exterior thereto and on each side of the horn 30 a shoulder or land 72 and 74 between the raised portion 70 and the respective sides 76 and 78 of the horn 30. Also, as is typical with some conventional drawbars, there is a cap 80 which extends upwardly from the central area of the raised portion 70 of the horn 30. The lower surface of each of the vertical support members 52 and 54 include respective recesses or cutouts 82 and 84 which are adapted to accommodate variations in the width of the horn 30 and raised portion 70 of different drawbars (AAR type E or F couplings) with most conventional drawbars having a horn with a width from 4 and ½ to 5 and ¾ inches. The vertical support members 52 and 54 are spaced a distance sufficient to allow the cap 80 to protrude up between the support members and, thereby, not interfere with the stable placement of the base 12 on top of the horn 30.

In accordance with a particular example of the present invention, the vertical support members 52 and 54 are formed of ½ inch or ⅝ inch thick steel plates that are machined to include the recesses 82 and 84 with the recess 82 being about 5 inches wide, preferably 4 and ⅝ inches, with a depth of at least ½ inch and the recess 84 having an overall width of about 6 inches, preferably 5 and ¾ inches, and a depth of at least ½ inch.

Although it is not preferred, it is contemplated that the vertical support members 52 and 54 may be replaced by a single block-like member having a recessed lower contour to accommodate variations in the width of different horns and raised portions and also including a cavity for accommodating a cap 80. Such a block may be made of a variety of durable materials including metals such as steel or aluminum or a hard plastic material. Further, although it is not preferred, it is contemplated that, in accordance with the present invention, each of the vertical support members 52 and 54 may include only a single recess or cutout having an overall width of about 6 inches, and a depth of 1 to 2 inches. Although such a design may not be as versatile as the two recess or compound recess design of FIGS. 1, 4, and 5, it may provide for adequate stability for certain types of drawbars.

The positioning bar 60 of base 12 is designed to abut with the buffing surface 32 of horn 30 when the knuckle hoist 10 is located in the correct operative position on the top of horn 30. Hence, positioning bar 60 facilitates and insures the correct positioning of the base 12 with respect to the horn 30. The bar 60 is attached to a depending portion of the central support member 62 by, for example, being welded thereto. The bar 60 is preferably made up of a ¼ to ½ inch, preferably ⅜ inch, thick steel bar having its ends bent to form L-shaped ends 88 and 90 which tend to wrap around the horn 30 and assist in positioning the base 12 on the horn 30.

Although it is not preferred, it is envisioned that the positioning bar 60 may be eliminated and that the depending portion of support member 62 will serve as a positioning member and abut against the buffing surface 32 of the horn 30.

In accordance with the exemplary embodiment shown in FIGS. 1 and 4 of the drawings, securing assembly 14 is made up of a length of link chain 92 halving one end fastened to the frame member 58 by nut and bolt 94 and the other end 96 of the chain being passed underneath the drawbar shank 26 and up over frame member 56 to a point whereat the chain 92 is drawn snug against the lower surface of the shank 26. In this position, a selected link 98 is inserted into a slot 100 in frame member 56 to secure the base 12 and hoist 10 to the drawbar 24. The width of groove 100 is selected to be just slightly larger than the width of a link in the chain 92. Further, the length of the chain 92 is selected so that the securing assembly 14 accommodates variations in the dimensions of conventional drawbars. Surprisingly, this eloquently simple securing assembly 14 provides for a stable operative positioning of the knuckle hoist 10 atop the drawbar 24. In accordance with one example, the chain 92 is a steel chain having links with a length of approximately 1 to 2 inches and a width of 3/16 and ⅜ of an inch.

It is contemplated that other more sophisticated means can be used to provide for adjustable attachment of chain 92 to frame members 56 and 58. For example, an over center lever or come-alone can be used to attach the end 96 of chain 92 to frame member 56.

As will be described in detail with respect to FIGS. 6 through 8, it is contemplated that the operative positioning the knuckle hoist 10 on drawbar 24 can be further stabilized by adding additional securing elements, for example lengths of chain and hooks which are adapted to have the hooks received in one the sand holes 34 through 40 of drawbar 24 and having an opposite end adapted to be connected to the base 12 or boom 18 to further stabilize the knuckle hoist from tilting.

The winch 16 is typical of manually operated winches designed to accommodate a rope, cord, or cable and includes a pair of vertical brackets 102 and 104 which are secured to frame members 56 and 58 by respective nuts and bolts 106. A reel, drum or spool 108 is mounted for rotation on the shaft of a bolt secured to vertical brackets 102 and 104. The lifting cable 20 has one end secured to the reel 108 and its other end attached to the lifting assembly 22.via a quick-disconnect link 112. The cable 20 is adapted to be wound around the reel 108 when the reel is rotated counterclockwise (as viewed in FIGS. 1 and 4) and to be unwound from the reel 108 when the reel is rotated clockwise.

Further, the winch 16 includes a hand crank 114 which is mounted on the end of a shaft 116 journaled in brackets 102 and 104 in a conventional manner so that clockwise rotation of the hand crank causes counterclockwise rotation of reel 108. Hand crank 114 includes a manually engageable handle portion rotatably mounted on a spindle 120 affixed to the outer end of a crank arm 122. Crank arm 122 is angled away from base 12 in order to avoid contact with support members 52 and 54 and with the horn 30 of drawbar 24. As is conventional with manually operated winches, shaft 116 has mounted thereon a small, toothed gear (located behind bracket 102) having teeth which intermesh with the teeth of a large gear 124 which is operatively connected to reel 108 so that clockwise rotation of the smaller gear causes counterclockwise rotation of the larger gear 124, thereby causing counterclockwise rotation of reel 108 and a reeling in or winding up of the lifting cable 20. Also as is conventional with manually operated winches, the winch 16 includes a latching mechanism (located behind bracket 102) which, in a first position, allows for free-wheeling of the gear 124 and reel so that the cable can be unwound or pulled from the reel, and, in a second position, allows only for counterclockwise rotation of the gear 124 and reel 108 and prevents clockwise rotation. Hence, a knuckle can be lifted from the ground by winding or reeling in the cable 20 onto reel 108 and will be held in its lifted position, since the latching mechanism will not allow the lifting cable to be pulled from the reel 108 and when in its second position. The latching mechanism is a conventional spring-biased catch which has a locking portion that fits within the space between the teeth of gear 124.

In accordance with the present invention, it is contemplated that the winch 16 may include a conventional handle or drum release mechanism to disconnect the hand crank 114 from the winch drive train when the lifting cable 20 is pulled from or unwound from reel 108 so that the crank handle 114 does not rotate counterclockwise as the lifting cable is pulled from the reel. Such a conventional handle or drum release mechanism would be provided for the convenience of the knuckle hoist operator to eliminate unnecessary and bothersome rotation of hand crank 114.

With reference again to FIGS. 1, 4 and 5 of the drawings, boom 18 is shown to include L-shaped side members 130 and 132 joined together near the base 12 by a first plate 134, joined intermediate their ends by a second plate 136 and joined near the free end of the boom 18 by third plate 138. Although the side members 130 and 132 are shown joined to plates 134, 136, and 138 by nuts and bolts, it is envisioned that the side members and plates may be permanently joined by welding.

The free end of boom 18 supports a pulley assembly 140, and is fixed to winch 16 by support rods or braces 142 and 144 each halving a first end secured to a respective winch bracket 102 and 104 and a second end attached to the free end of side members 130 and 132. Thus, support rods 142 and 144 help to maintain boom in its angled posture. Boom 18 is fixed to base 12 by having plate 134 bolted or welded to an upwardly extending end of support member 62 of base 12.

Pulley assembly 140 includes a grooved guide pulley 146 Journaled on a shaft 148 supported in side members 150 and 152. The pulley assembly side members 150 and 152 are joined together and pulley assembly 140 is joined to boom 18 by a bolt 154 wrapped around a portion of side members 150 and 152 and attached to the plate 138 by a nut. However, it is to be understood that pulley assembly 140 may be joined to boom 18 by welding side members 150 and 152 to side members 130 and 132. A lifting cable guide member 156 in the form of an inverted U or V is attached to boom side members 130 and 132 adjacent pulley assembly 140 to keep lifting cable 20 aligned with and in contact with pulley 146. Guide member 156 may be fixed to boom 18 via threaded fasteners 158 or by welding.

Although the exemplary knuckle hoist assembly including the base 12, winch 16 and boom 18 is shown and described as a rigid assembly wherein the boom is cantilevered from the base at a fixed upwardly extending angle, it is contemplated that an alternative arrangement with the boom 18 being hingedly or pivotally supported with respect to the base 12 and having its upwardly extending angle determined by the length of support rods or braces 142 and 144, may provide for sufficient strength to lift a knuckle while at the same time allowing for the boom 18 to be folded back upon base 12 and winch 16 for compact storage with support rods 142 and 144 disconnected from the free end of boom 18. It is not necessary that boom 18 be pivotally supported with respect to base 12 since the knuckle hoist as shown and described in a rigid, sturdy, and durable form, is already compact and easily stored on, for example, the engine of a train since the overall length of the base and boom, is less than three feet and preferably less than two feet from end-to-end.

With the exception of components such as base support members 52 and 54 and positioning bar 60, it is preferred that the hoist components be made of a sturdy and durable material, such as 3/16 to $\frac{3}{8}$ inch thick, preferably $\frac{1}{4}$ inch thick, steel stock joined together by welding or by heavy-duty nuts and bolts with either dual nuts or lock washers to insure that the components do not separate during use or storage. It is to be understood that other materials, such as aluminum, may be used to provide the same durability, rigidity and strength while reducing the weight of the device.

Figure 3:
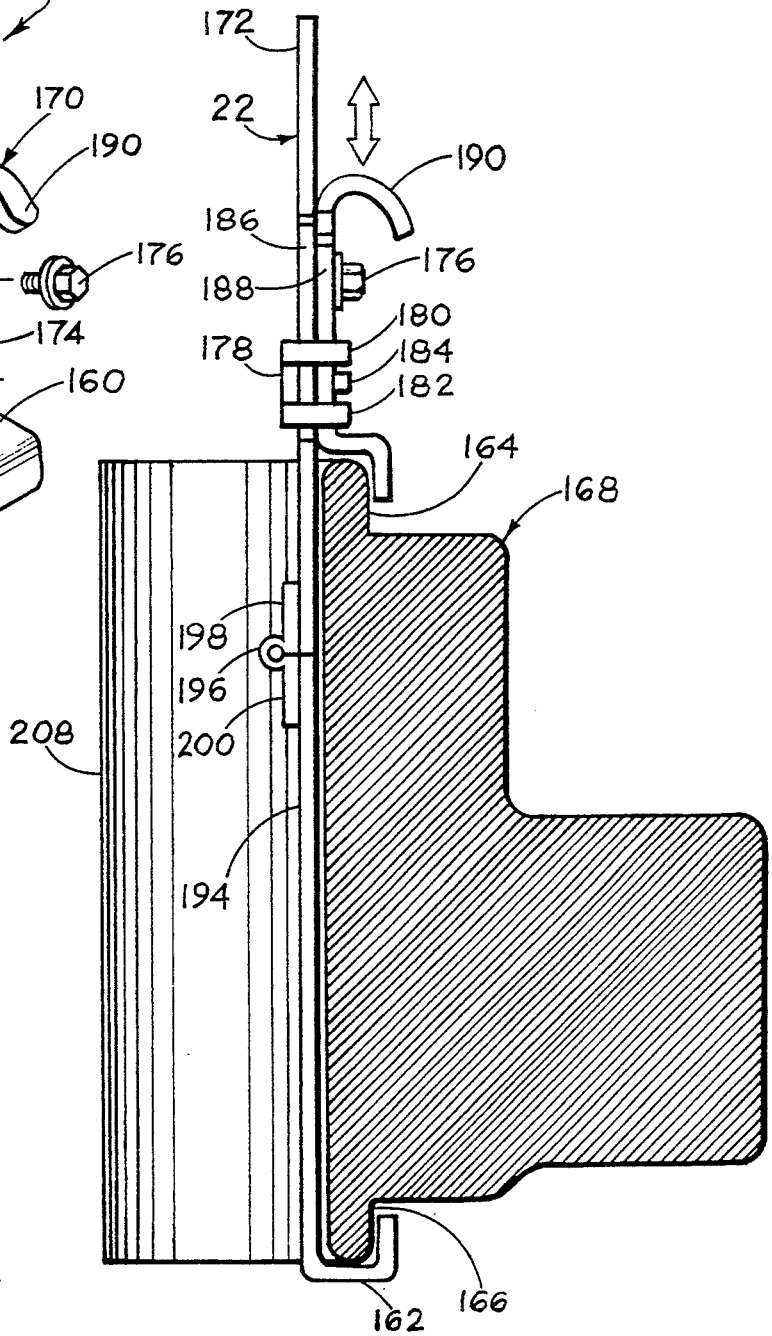
FIG. 3 is a side view illustration of the lifting assembly of FIG. 1 shown in an operative position clamped onto a knuckle.

With respect to FIGS. 1 through 5 of the drawings, the lifting assembly 22 is shown to include upper and lower clamping elements 160 and 162 adapted to receive upper and lower flanges 164 and 166 of a knuckle 168 (FIGS. 3 through 5). Upper clamping element 160 is an L-shaped lower end of a slide member 170 which is fixed to an upper assembly section member 172 in a manner allowing for vertical movement of the slide 170 relative to the section member 172. Slide member 170 includes an elongate slot 174 which receives the shaft of a stud 176 fixed to upper section member 172. A collar 178 having tabs 180, 182, and 184 bent over slide member 170 keeps slide member 170 in abutting relationship with section member 172 during movement of slide member 170 relative to section member 172. Sliding movement of slide member 170 relative to section member 172 is limited by the length of slot 174 and also by having collar 178 ride in a reduced width or neck down portion 186 of upper section member 172 and 188 of slide 170. To facilitate manipulation of slide member 170 to raise and lower clamping element 160 relative to a knuckle, slide member 170 includes an arcuate upper end 190 which serves as a handle to be grasped by the thumb and forefinger of the user. The upper end of section member 172 includes a circular opening 192 for receiving the quick-disconnect link 112 and, thereby, providing for attachment of the lifting assembly 22 to lifting cable 20.

Lower clamping element 162 is the lower J-shaped end of a lower section member 194 joined to upper section member 172 via a hinge 196. Hinge 196 has upper and lower wings 198 and 200 which are joined respectively to upper and lower section members 172 and 194 by threaded fasteners or by welding. Having the lifting assembly 22 formed of upper and lower sections 172 and 194 hingedly connected by hinge 196 allows the lifting assembly to be folded while not in use to provide for compact storage of the lifting assembly 22 on top of boom 18, that is between boom side members 130 and 132 in an area on top of plates 134 and 136. This provides for compact storage of the entire knuckle hoist 10 when not in use. Although it is preferred to have lifting assembly 22 formed of upper and lower section members, it is contemplated that lifting assembly 22 may alternatively be formed of a single member.

In accordance with one embodiment of the present invention, the knuckle hoist 10 is used to replace a broken, missing, or damaged knuckle in the drawbar 24 of a railroad coupling including the drawbar 24, a coupler striker 202 connected to an end sill 204 of a railway car which rides on a railroad track 206 (FIG. 4) by preparing the drawbar 24 to receive the knuckle 168, then placing the knuckle hoist 10 on top of the horn 30 of the drawbar 24 with the support members 52 and 54 positioned with the horn 30 located within recess 84 of each of the support members and with positioning bar 60 abutting the buffing surface 32 of the horn 30. Next, chain 92 is wrapped around the shank 26 of the drawbar 24 and a selected link 98 of the chain 92 is placed within the groove 100 in frame member 56 to secure the base 12 and knuckle hoist 10 to the drawbar 24.

Thereafter, a sufficient length of the lifting cable 20 is pulled from reel 108 to allow lifting assembly 22 to be clamped onto a knuckle 168 resting on the railroad track 206 below the drawbar 24. Next, the upper clamping element 160 is moved upwardly away from lower clamping element 162 a sufficient distance to allow the lower clamping element 162 to be placed over the lower flange 166 of knuckle 168 and have lower section member 194 brought up into abutting relationship with the planar face of the knuckle 168. After this is accomplished, upper clamping element 160 is lowered down in position to engage upper knuckle flange 164 and thereby clamp the knuckle 168 between the upper and lower clamping elements 160 and 162 and, as such, attach the lifting assembly 22 to the knuckle 168.

After the lifting assembly 22 has been attached to knuckle 168, hand crank 114 is rotated in a clockwise direction (as viewed in FIGS. 1 and 4) to raise the knuckle from the railroad track by having lifting cable 20 wound around reel 108. Hand crank 114 is rotated clockwise until the knuckle 168 is located adjacent the coupling head 28 of the drawbar 24 with the knuckle adjacent the knuckle receiving recess 44 in the drawbar 24. The winch 16 includes a conventional latch mechanism which is placed in a locking position so that, once the knuckle has been raised to the appropriate height and location in front of the drawbar 24, the operator can release hand crank 114 and move to a position in front of the coupling head 28 in order to complete the knuckle replacement process.

With the knuckle hoist 10 holding the knuckle 168 up in front of the coupling head 28, the knuckle 168 is easily pushed into position so that a portion of the knuckle 168 is received within the knuckle receiving recess 44 and a cylindrical part 208 of the knuckle 168 is brought into alignment with the knuckle protectors 48 and 50 of coupling head 28 sufficiently to align the knuckle pin receiving bores of protectors 48 and 50 and cylinder 208 to allow the shaft 210 extending from a handle of a temporary reduced diameter knuckle pin or holding pin 214 to be received within the knuckle pin receiving bores of protector 48 and cylinder 208 to temporarily hold the knuckle 168 in position partially inserted within the knuckle receiving recess 44. With the knuckle temporarily held in position by temporary knuckle pin 214, lifting assembly 22 is removed from knuckle 168 by having upper clamping element 160 slid upwardly and away from flange 164 a sufficient distance to allow the section members and 194 to be moved away from the knuckle 168 and lower clamping element 162 to be pulled away from lower flange 166 of the knuckle 168, Hence, lifting assembly 22 is removed from the knuckle and the knuckle hoist 10 is free to be removed from the drawbar 24 by releasing chain 92 from slot 100 in frame member 56 and moving base 12 off of the horn 30 of the drawbar 24.

With the lifting assembly 22 removed from the knuckle 168, the knuckle 168 is easily pushed into final position within the coupling head 28 and knuckle receiving recess 44 so that with the knuckle pin receiving bores of upper and lower protectors 48 and 50 and cylinder 208 are coaxially aligned to receive a permanent knuckle pin. With the knuckle pin receiving bores or openings coaxially aligned, the temporary holding pin 214 is removed and a permanent knuckle pin is inserted. Thereafter, a knuckle pin retaining key is inserted. The temporary holding pin 214 and lifting assembly 22 are easily stored on the upper surface of boom 18 between side members 130 and 132 to provide for compact storage of the knuckle hoist 10 on, for example, the engine of a train.

A knuckle can be removed from the coupling head of a drawbar and lowered to the railroad track or Just moved away from the coupling head to allow for removal and replacement of a damaged or broken knuckle pin by simply reversing the above-described process, placing the coupling head in condition to receive a knuckle, and then proceeding with the process as described above for replacing a knuckle.

The above-described processes provide for the safe, efficient, and effective replacement of a broken, missing, or damaged knuckle, the replacement of a damaged or broken knuckle pin and the operative positioning of a knuckle within the knuckle receiving recess of a coupling head of a drawbar by one or more trainmen.

Figure 6:
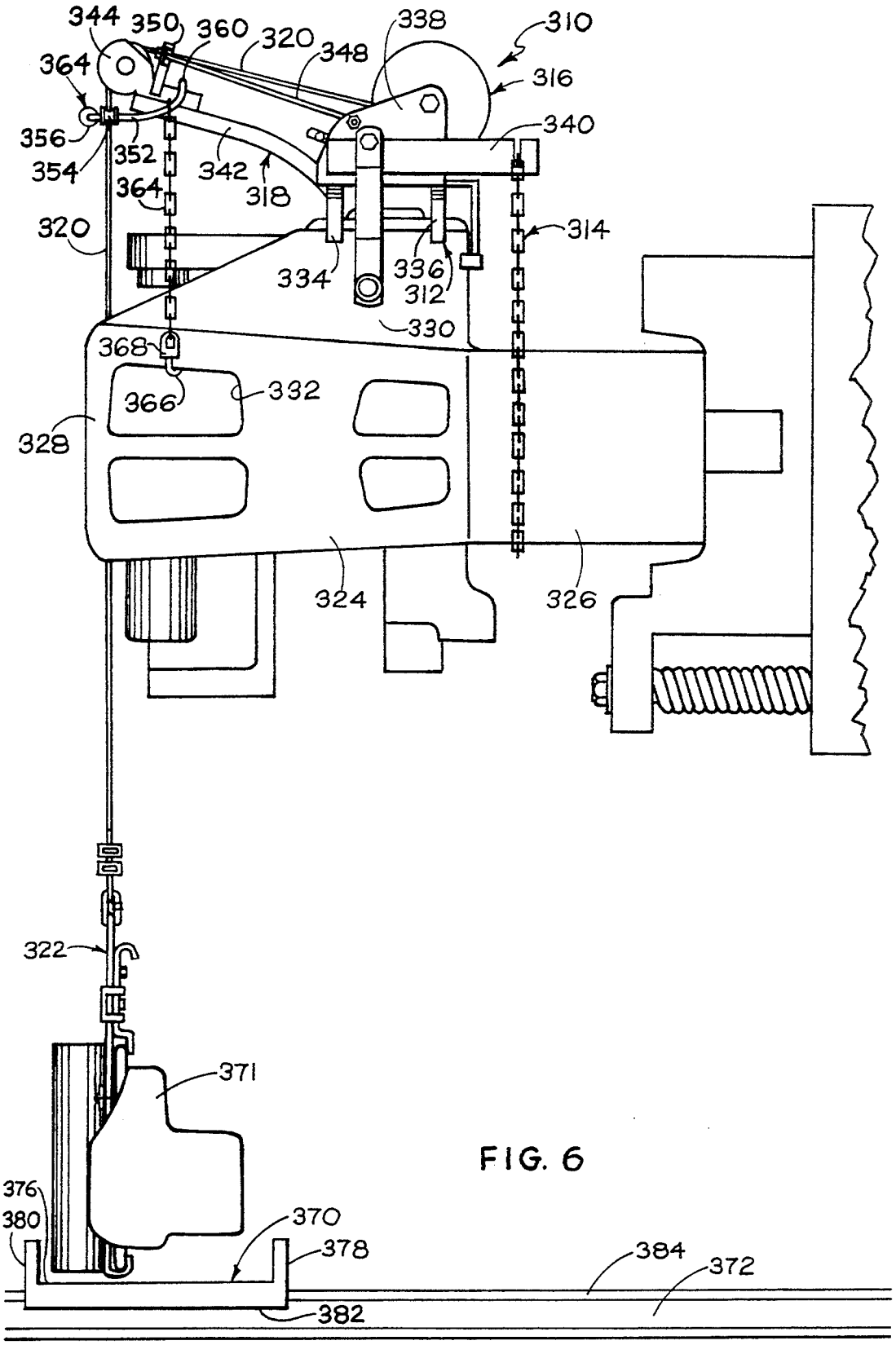
FIG. 6 is a schematic side view representation of a knuckle hoist in accordance with another embodiment of the present invention.
Figure 7:
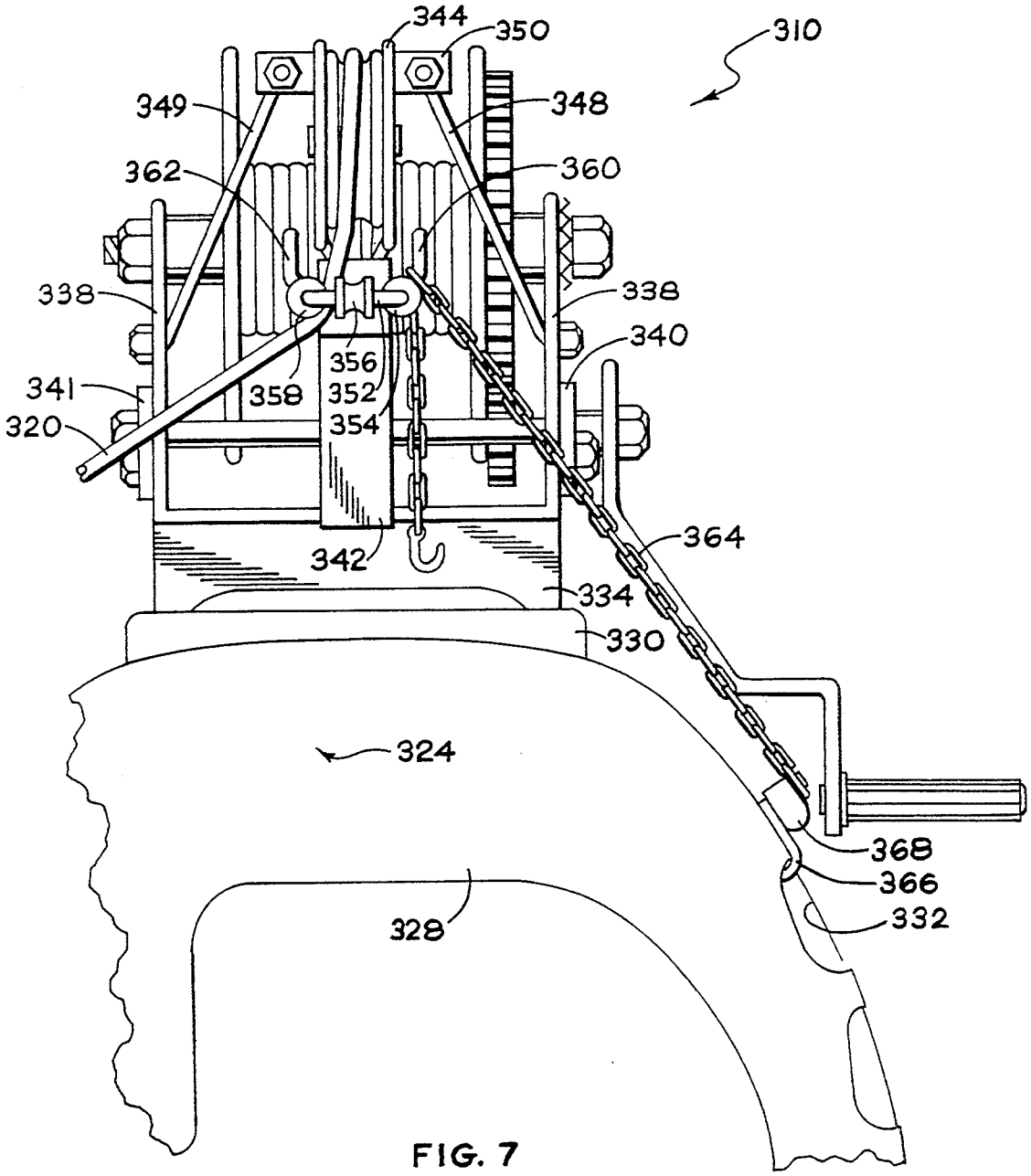
FIG. 7 is a schematic front view illustration of the knuckle hoist of FIG. 6.
Figure 8:
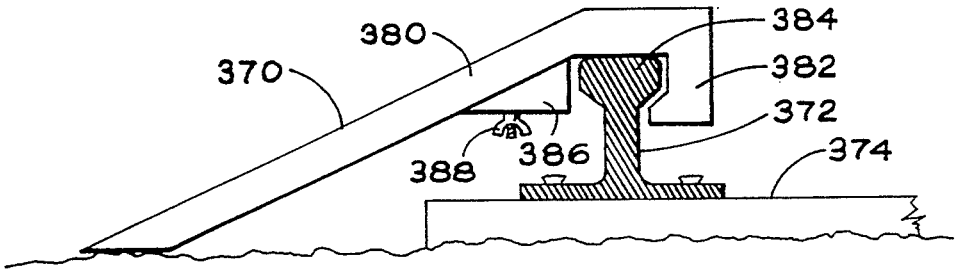
FIG. 8 is a side view representation of a ramp used to facilitate the movement of a knuckle over a railroad track rail.

In accordance with an alternative embodiment of the present invention and as shown in FIGS. 6 through 8 of the drawings, a knuckle hoist generally designated by the reference numeral 310 is shown to include a base 312, a first securing chain 314, a winch 316, a boom 318, a lifting cable 320, and a lifting assembly 322. The knuckle hoist 310 is mounted atop a conventional drawbar 324 having a shank 326, a coupling head 328, a horn 330, and a sand hole 332. The knuckle hoist 310 is substantially the same as the knuckle hoist 10 of FIGS. 1 through 5 and is operated In substantially the same manner except as described below.

The base 312 and winch 316 differ from the base 12 and winch 16 In that the base 312 includes vertical support members 334 and 336 which are welded to a U-shaped winch support bracket 338. Also, the base 312 includes frame members 340 and 341 which are connected to opposite sides of the winch bracket 338.

The boom 318 differs from the boom 18 in that the L-shaped members and plates have been replaced with a single, square, steel bar 342, preferably ½ inch square, having one end welded to the winch bracket 338 and support member 334 and having Its other end welded to a pulley assembly 344 and a lower, lifting cable guide assembly 346. The boom 318 also differs from the boom 18 In that support rods or braces 348 and 349 are connected to an upper, lifting cable guide member 350 which is itself welded to pulley assembly 344.

Lower, lifting cable guide assembly 346 is shown to include a U-shaped member 352 which serves as a journal for three small size cable guide pulleys 354, 356, and 358 and which has upstanding hooks 360 and 362 at each end. The member 352 Is welded to the boom 318 at the base of each of the hooks 360 and 362. The hooks 360 and 362 are adapted to receive a link of a second securing chain 364 having at its lower end a hook 366 adapted to be received In sand hole 332 of the drawbar 324. In the embodiment shown In FIGS. 6 and 7 of the drawings, the second securing chain 364 is a conventional uncoupling lever retaining tool which has been modified by adding tile hook 366 to a cup or cylindrical portion 368 which is welded to chain 364.

The lower, lifting cable guide assembly 346 and second securing chain 364 provide greater stability to the knuckle hoist 310 and adapt the knuckle hoist 310 for dragging a knuckle from a railroad track right-of-way to one side of the drawbar 324. This substantially reduces or eliminates the need for manual movement (dragging or lifting) of the knuckle during the replacement or placement of a knuckle in operative position in the coupling head 328 of the drawbar 324.

With respect to FIGS. 6 and 8 of the drawings, a knuckle ramp 370 is used in conjunction with the knuckle hoist 310 or 10 to facilitate the dragging of a knuckle 371 over a railroad track rail 372 of a railroad track 374. The ramp 370 has a floor 376, upstanding side walls 378 and 380, and a hook-like front end 382 adapted to fit over the upper, enlarged end 384 of track rail 372. The ramp 370 further includes an adjustable stop 386 attached to floor 376 by a bolt and wing nut 388. The wing nut 388 can be loosened and adjustable stop 386 brought to bear against the upper end 384 of track rail 372 in order to prevent movement of the ramp 370 during use. The upstanding walls 378 and 380 of ramp 370 keep the knuckle 371 from falling off of the ramp while it is being dragged over the track rail 372 by operation of knuckle hoist 310.

A conventional uncoupling lever retaining tool includes a length of chain having a chain grab hook at one end and a cylindrical portion, cup or cap at the other end. Such a conventional lever retaining tool is adapted for retaining a railroad coupler uncoupling lever in its uppermost position which corresponds to releasing or opening of the coupler and unlocking of a knuckle locking mechanism. This is done by having the trainman or mechanic release the coupler and hold the uncoupling lever in its uppermost position, placing the cylindrical portion of the lever retaining tool over the end of the uncoupling lever, wrapping the chain around a ladder tread of the railroad car and securing the chain grab hook to the chain and thereby holding or retaining the uncoupling lever and knuckle locking mechanism in the unlocked position. If the sand hole hook 366 is attached to a conventional uncoupling lever retaining tool, then there should be at least two such lever retaining tools stored alone with the knuckle hoist 310 so that one can be used to retain the uncoupling lever In its uppermost released position and the other used as the second anchoring chain 364 for attaching the knuckle hoist 310 to the drawbar 324 in a stable operative position.

The knuckle hoist 310 is used to drag a knuckle off the right-of-way of a railroad track into a position directly beneath the drawbar, lift the knuckle to an installing position in front of the coupling head of the drawbar, and hold the knuckle while it is being installed using a temporary holding pin.

Thus, it will be appreciated that, as a result of the present invention, a highly effective, improved railroad coupling knuckle hoist and method is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

What is claimed is:

1. A portable knuckle hoist adapted for temporary operative placement on the upper surface of a railroad car coupling drawbar in a position to assist in raising a knuckle to the knuckle receiving opening in the free end of the drawbar comprising:

a base adapted for placement on a raised central portion of a drawbar and including securing means for temporarily attaching the base to the drawbar, wherein said securing means comprises a length of chain having one end secured to one side of said base and a groove in the other side of said base having a width slightly larger than the width of one of the links in said chain and adapted to receive a selected one of the links in the other end of said chain after the chain has been passed under the neck of the drawback a winch attached to the base and including a hand crank, a reel, a length of cable having a first end secured to the reel and adapted to be wound around said reel, and associated gearing for transferring motion from said hand crank to said reel a boom attached to a forward end of said base and extending upwardly at an angle, said boom having a free end and at least one guide pulley secured to said free end, and a jig attached to a second end of the cable and adapted to be temporarily clamped on to a knuckle to be raised by the hoist.

2. An apparatus including a portable knuckle hoist mounted on a railroad car coupling drawbar, to assist in raising a knuckle to a knuckle receiving opening at a free end of said drawbar, said hoist comprising:

a base mounted on a raised horn of said drawbar, a securing means for temporarily attaching said base to said drawbar, a winch attached to said base and including a hand crank, a reel, a length of cable with a first end wound around said reel, and gearing for transferring motion from said hand crank to said reel, a boom attached to a forward end of said base and extending upwardly at an angle, said boom having a free end and at least one guide pulley secured to said free end, and a jig attached to a second end of said cable, for temporarily clamping said knuckle, said base further including first and second vertical support members oriented transversely to the length of said drawbar and including at least one recess receiving said raised horn of said drawbar, and a positioning bracket attached to at least one of said vertical support members and engaging a rear surface of said raised horn of said drawbar to insure correct positioning of said hoist on said drawbar.

3. The apparatus as recited in claim 2, wherein said raised horn of said drawbar includes a raised portion at the top said raised horn, said at least one recess comprises a compound recess for accommodating said raised horn including said raised portion, and said support members includes portions extending down along the sides of said raised horn of said drawbar.

4. The apparatus as recited in claim 2, wherein said raised horn of said drawbar includes a cap on an upper extremity of said horn, and said support members are spaced apart on the drawbar in such a manner that is not interfere with said cap on said horn.

5. In a railroad car coupling including a knuckle, a knuckle pin and a drawbar, the improvement comprising:

a manually operated portable knuckle hoist temporarily attached to an upper surface of said drawbar in a position to assist in raising the knuckle for attachment to said drawbar by said knuckle pin, said knuckle hoist including a jig for temporarily attachment to said knuckle, and a temporary reduced diameter knuckle pin for holding said knuckle in position during removal of said jig.

* * * * *